US007353625B2

(12) United States Patent
Ellis et al.

(10) Patent No.: US 7,353,625 B2
(45) Date of Patent: Apr. 8, 2008

(54) RESILIENT CUSHIONING DEVICE FOR THE HEEL PORTION OF A SOLE

(75) Inventors: Todd Ellis, Boston, MA (US); Geoffrey Swales, Somerset, MA (US); William McInnis, Mendon, MA (US); Paul Bates, Canton, MA (US)

(73) Assignee: Reebok International, Ltd., Canton, MA (US)

( * ) Notice: Subject to any disclaimer, the term of this patent is extended or adjusted under 35 U.S.C. 154(b) by 316 days.

(21) Appl. No.: 10/978,568

(22) Filed: Nov. 2, 2004

(65) Prior Publication Data

US 2005/0120590 A1 Jun. 9, 2005

Related U.S. Application Data

(60) Provisional application No. 60/516,298, filed on Nov. 3, 2003.

(51) Int. Cl.
*A43B 13/18* (2006.01)
*A43B 13/20* (2006.01)

(52) U.S. Cl. ..... 36/29; 36/28

(58) Field of Classification Search ..... 36/28, 36/29, 35 R, 35 B

See application file for complete search history.

(56) References Cited

U.S. PATENT DOCUMENTS

| | | | |
|---|---|---|---|
| 545,705 | A | 9/1895 | MacDonald |
| 547,645 | A | 10/1895 | Lacroix |
| 836,364 | A | 11/1906 | Busby |
| 896,075 | A | 8/1908 | Badgley |
| 900,867 | A | 10/1908 | Miller |
| 1,069,001 | A | 7/1913 | Guy |
| 1,193,608 | A | 8/1916 | Poulson |
| 1,498,838 | A | 6/1924 | Harrison, Jr. |
| 1,605,985 | A | 11/1926 | Rasmussen |
| 1,711,270 | A | 4/1929 | Little, Jr. |

(Continued)

FOREIGN PATENT DOCUMENTS

| | | |
|---|---|---|
| DE | 820 869 | 11/1951 |

(Continued)

OTHER PUBLICATIONS

Translation of Japanese Patent Application No. HEI 6-181802, 46 pages.

(Continued)

*Primary Examiner*—Marie Patterson
(74) *Attorney, Agent, or Firm*—Sterne, Kessler, Goldstein & Fox, P.L.L.C.

(57) ABSTRACT

A shoe includes a sole for cushioning a heelstrike. The sole includes a midsole, an optional outsole, and a resilient cushioning device. The resilient cushioning device includes a bottom component, a top component sealingly attached to the bottom component, wherein the top component includes a corrugated sidewall. The resilient cushioning device is a closed system that contains a fluid, such as a gas either at atmospheric pressure or pressurized. The resilient cushioning device may have only one interior compartment or a series of compartments fluidly connected to one another. The resilient cushioning device is partially embedded within the midsole in a heel region of the sole, although at least a portion of the sidewall of the resilient cushioning device remains visible from the exterior of a shoe sole.

20 Claims, 14 Drawing Sheets

U.S. PATENT DOCUMENTS

| | | | | |
|---|---|---|---|---|
| 1,970,802 | A | 8/1934 | Johnson | |
| 2,068,134 | A | 1/1937 | Houghton | |
| 2,080,499 | A | 5/1937 | Nathansohn | |
| 2,090,881 | A | 8/1937 | Wilson | |
| 2,100,492 | A | 11/1937 | Sindler | |
| 2,215,463 | A | 9/1940 | Di Mauro | |
| 2,266,476 | A | 12/1941 | Riess | |
| 2,318,206 | A | 5/1943 | Eisenlohr | |
| 2,434,770 | A | 1/1948 | Lutey | |
| 2,468,886 | A | 5/1949 | Lutey | |
| 2,604,641 | A | 7/1952 | Reed | |
| 2,817,088 | A | 12/1957 | Vrana | |
| 2,881,445 | A | 4/1959 | Vrana | |
| 3,100,354 | A | 8/1963 | Lombard et al. | |
| 3,120,712 | A | 2/1964 | Menken | |
| 3,180,039 | A * | 4/1965 | Burns, Jr. | 36/3 R |
| 3,225,463 | A | 12/1965 | Burnham | |
| 3,332,415 | A | 7/1967 | Ericson | |
| 3,341,952 | A | 9/1967 | Dassler | |
| 3,402,485 | A | 9/1968 | McMorrow | |
| 3,469,576 | A | 9/1969 | Smith et al. | |
| 3,583,008 | A | 6/1971 | Edwards | |
| 3,608,215 | A | 9/1971 | Fukuoka | |
| 3,638,253 | A | 2/1972 | Stumpf | |
| 3,705,429 | A | 12/1972 | Nail | |
| 4,100,686 | A | 7/1978 | Sgarlato et al. | |
| 4,183,156 | A | 1/1980 | Rudy | |
| 4,217,705 | A | 8/1980 | Donzis | |
| 4,219,945 | A | 9/1980 | Rudy | |
| 4,247,963 | A | 2/1981 | Reddi | |
| 4,259,792 | A | 4/1981 | Halberstadt | |
| 4,263,728 | A | 4/1981 | Frecentese | |
| 4,297,797 | A | 11/1981 | Meyers | |
| 4,312,140 | A | 1/1982 | Reber | |
| 4,358,902 | A | 11/1982 | Cole et al. | |
| 4,372,058 | A | 2/1983 | Stubblefield | |
| 4,405,129 | A | 9/1983 | Stuckey | |
| 4,446,634 | A | 5/1984 | Johnson et al. | |
| 4,458,430 | A | 7/1984 | Peterson | |
| 4,471,538 | A | 9/1984 | Pomeranz et al. | |
| 4,486,964 | A | 12/1984 | Rudy | |
| 4,507,879 | A | 4/1985 | Dassler | |
| 4,536,974 | A | 8/1985 | Cohen | |
| 4,546,556 | A | 10/1985 | Stubblefield | |
| 4,547,919 | A | 10/1985 | Wang | |
| 4,547,978 | A | 10/1985 | Radford | |
| 4,577,417 | A | 3/1986 | Cole | |
| 4,593,482 | A | 6/1986 | Mayer | |
| 4,611,412 | A | 9/1986 | Cohen | |
| 4,670,995 | A | 6/1987 | Huang | |
| 4,670,997 | A | 6/1987 | Beekman | |
| 4,724,560 | A | 2/1988 | Christie | |
| 4,741,114 | A | 5/1988 | Stubblefield | |
| 4,763,426 | A | 8/1988 | Polus et al. | |
| 4,768,295 | A * | 9/1988 | Ito | 36/28 |
| 4,779,359 | A | 10/1988 | Famolare, Jr. | |
| 4,799,319 | A | 1/1989 | Zellweger | |
| 4,817,304 | A | 4/1989 | Parker et al. | |
| 4,833,795 | A | 5/1989 | Diaz | |
| 4,845,861 | A | 7/1989 | Moumdjian | |
| 4,856,208 | A | 8/1989 | Zaccaro | |
| 4,887,367 | A | 12/1989 | Mackness et al. | |
| 4,918,838 | A | 4/1990 | Chang | |
| 4,936,030 | A | 6/1990 | Rennex | |
| 4,999,931 | A | 3/1991 | Vermeuen | |
| 5,005,575 | A | 4/1991 | Gerri | |
| 5,014,449 | A | 5/1991 | Richard et al. | |
| 5,022,109 | A | 6/1991 | Pekar | |
| 5,025,575 | A | 6/1991 | Lakic | |
| 5,074,765 | A | 12/1991 | Pekar | |
| 5,113,599 | A | 5/1992 | Cohen et al. | |
| 5,131,174 | A | 7/1992 | Drew et al. | |
| 5,144,708 | A | 9/1992 | Pekar | |
| RE34,102 | E | 10/1992 | Cole et al. | |
| 5,158,767 | A | 10/1992 | Cohen et al. | |
| 5,179,792 | A | 1/1993 | Brantingham | |
| 5,195,257 | A | 3/1993 | Holcomb et al. | |
| 5,228,156 | A | 7/1993 | Wang | |
| 5,230,249 | A | 7/1993 | Sasaki et al. | |
| 5,235,715 | A | 8/1993 | Donzis | |
| 4,219,245 | A | 10/1993 | Rudy | |
| 5,253,435 | A | 10/1993 | Auger et al. | |
| 5,255,451 | A | 10/1993 | Tong et al. | |
| 5,295,314 | A | 3/1994 | Moumdjian | |
| 5,311,674 | A | 5/1994 | Santiyanont et al. | |
| 5,313,717 | A | 5/1994 | Allen et al. | |
| 5,335,382 | A | 8/1994 | Huang | |
| 5,343,639 | A | 9/1994 | Kilgore et al. | |
| 5,353,459 | A | 10/1994 | Potter et al. | |
| 5,353,525 | A | 10/1994 | Grim | |
| 5,363,570 | A * | 11/1994 | Allen et al. | 36/28 |
| 5,367,792 | A | 11/1994 | Richard et al. | |
| 5,375,346 | A | 12/1994 | Cole et al. | |
| 5,395,674 | A | 3/1995 | Schmidt et al. | |
| 5,406,661 | A | 4/1995 | Pekar | |
| 5,406,719 | A * | 4/1995 | Potter | 36/28 |
| 5,416,986 | A | 5/1995 | Cole et al. | |
| 5,425,184 | A * | 6/1995 | Lyden et al. | 36/29 |
| 5,443,529 | A | 8/1995 | Phillips | |
| 5,533,282 | A | 7/1996 | Kataoka et al. | |
| 5,545,463 | A | 8/1996 | Schmidt et al. | |
| 5,572,804 | A | 11/1996 | Skaja et al. | |
| 5,607,749 | A * | 3/1997 | Strumor | 428/156 |
| 5,625,964 | A | 5/1997 | Lyden et al. | |
| 5,625,965 | A | 5/1997 | Blissett et al. | |
| 4,259,792 | A | 8/1997 | Halberstadt | |
| 5,655,315 | A * | 8/1997 | Mershon | 36/97 |
| 5,664,341 | A | 9/1997 | Schmidt et al. | |
| 5,678,327 | A | 10/1997 | Halberstadt | |
| 5,679,439 | A | 10/1997 | Schmidt et al. | |
| 5,701,687 | A | 12/1997 | Schmidt et al. | |
| 5,704,137 | A * | 1/1998 | Dean et al. | 36/28 |
| 5,706,589 | A | 1/1998 | Marc | |
| 5,741,568 | A | 4/1998 | Rudy | |
| 5,755,001 | A | 5/1998 | Potter et al. | |
| 5,771,606 | A | 6/1998 | Litchfield et al. | |
| 5,784,807 | A | 7/1998 | Pagel | |
| 5,794,361 | A | 8/1998 | Sadler | |
| 5,802,739 | A | 9/1998 | Potter et al. | |
| 5,826,349 | A | 10/1998 | Goss | |
| 5,832,630 | A | 11/1998 | Potter | |
| 5,842,291 | A | 12/1998 | Schmidt, et al. | |
| 5,896,681 | A | 4/1999 | Lin | |
| 5,901,467 | A * | 5/1999 | Peterson et al. | 36/29 |
| 5,930,918 | A | 8/1999 | Healy et al. | |
| 6,158,149 | A | 12/2000 | Rudy | |
| 6,266,897 | B1 | 7/2001 | Seydel et al. | |
| 6,354,020 | B1 | 3/2002 | Kimball et al. | |
| RE37,705 | E | 5/2002 | Donzis | |
| 6,425,195 | B1 | 7/2002 | Donzis | |
| 6,453,577 | B1 | 9/2002 | Litchfield et al. | |
| 6,505,420 | B1 | 1/2003 | Litchfield et al. | |
| 6,516,540 | B2 | 2/2003 | Seydel et al. | |
| 6,519,873 | B1 | 2/2003 | Buttigieg | |
| 6,568,102 | B1 | 5/2003 | Healy et al. | |
| 6,689,314 | B2 | 2/2004 | Bushman et al. | |
| 6,745,499 | B2 | 6/2004 | Christensen et al. | |
| D495,127 | S | 8/2004 | Marvin et al. | |
| 6,845,573 | B2 | 1/2005 | Litchfield et al. | |
| 2001/0049888 | A1 | 12/2001 | Krafsur | |
| 2002/0121031 | A1 | 9/2002 | Smith et al. | |
| 2003/0009913 | A1 * | 1/2003 | Potter et al. | 36/29 |
| 2004/0261293 | A1 | 12/2004 | Marvin et al. | |

2005/0016021 A1* 1/2005 Marvin et al. ..... 36/29

FOREIGN PATENT DOCUMENTS

| | | | |
|---|---|---|---|
| DE | 28 00 359 | A1 | 7/1979 |
| EP | 0 095 357 | A1 | 11/1983 |
| EP | 0 714 613 | | 6/1999 |
| FR | 720257 | A2 | 2/1932 |
| FR | 2 614 510 | A1 | 11/1988 |
| FR | 2 663 208 | | 12/1991 |
| GB | 338266 | | 11/1930 |
| GB | 2 039 717 | A | 8/1980 |
| GB | 2 085 278 | A | 4/1982 |
| GB | 2 114 425 | A | 8/1983 |
| GB | 2 201 082 | A | 8/1988 |
| JP | 6-181802 | | 7/1994 |
| WO | WO 89/06500 | A1 | 2/1989 |
| WO | WO 91/11931 | A1 | 8/1991 |
| WO | WO 91/16831 | A1 | 11/1991 |
| WO | WO 93/12685 | A1 | 7/1993 |
| WO | WO 93/14659 | A1 | 8/1993 |
| WO | WO95/20332 | | 8/1995 |
| WO | WO98/09546 | | 3/1998 |
| WO | WO 01/19211 | A1 | 3/2001 |

OTHER PUBLICATIONS

Photographs of Nike Air Force 180 shoe. Nike Air Force 180 shoes were on sale prior to Nov. 1993.
Brochure of the Nike Air Force 180 shoe. Brochure was included with shoes on sale prior to Nov. 1993.
U.S. Appl. No. 07/919,952, Edington et al., filed Jul. 27, 1992.
Zonic Brochure, undated.
Abstract for German patent publication DE 28 00 359 A1.

* cited by examiner

RESILIENT CUSHIONING DEVICE FOR THE HEEL PORTION OF A SOLE

BACKGROUND OF THE INVENTION

1. Field of the Invention

The field of this invention generally relates to footwear, and more particularly to an article of footwear having a fluid-filled resilient cushioning device in a sole that provides dynamic cushioning and support for the comfort of the wearer.

2. Background of the Invention

One of the problems associated with footwear, especially athletic shoes, has always been striking a balance between support and cushioning. Throughout the course of an average day, the feet and legs of an individual are subjected to substantial impact forces. Running, jumping, walking, and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, a typical gait cycle for running or walking begins with a "heelstrike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the Achilles tendon and the arch stretch and contract, storing and releasing energy in the tendons and ligaments. Rolling the foot forward through the step from the heelstrike to the toe-off releases the energy stored in the Achilles tendon and arch, which helps to propel the foot into the toe-off.

Although the human foot possesses natural cushioning and rebounding characteristics, the foot is greatly assisted in effectively overcoming many of the forces encountered during athletic activity through the use of appropriate footwear. Unless an individual utilizes footwear which provides proper cushioning and support, the soreness and fatigue associated with athletic activity is more acute, and its onset is accelerated. The discomfort for the wearer that results may diminish the incentive for further athletic activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part by incorporating a sole (typically including an outsole, midsole and insole) which absorbs shocks. However, the sole should also possess enough resiliency to prevent the sole from being "mushy" or "collapsing," thereby unduly draining the energy of the wearer. Ideally, the footwear would also mechanically assist the foot through the step by releasing stored energy simultaneously to the release of energy stored within the Achilles tendon and the arch, thereby contributing to the springiness of the step.

In light of the above, numerous attempts have been made to incorporate into a shoe improved cushioning and resiliency. For example, attempts have been made to enhance the natural elasticity and energy return of the foot by providing shoes with soles which store energy during compression and return energy during expansion. These attempts have included the formation of shoe soles that include springs, gels or foams such as ethylene vinyl acetate (EVA) or polyurethane (PU). However, all of these tend to either break down over time or do not provide adequate cushioning characteristics.

Another concept practiced in the footwear industry to improve cushioning and energy return has been the use of fluid-filled systems within shoes soles. The basic concept of these devices is to have cushions containing pressurized fluid disposed adjacent the heel and/or the forefoot regions of a shoe.

A particular area in need of cushioning is the heel region. As noted above, when running or walking in a typical fashion, the heel region of the foot or shoe strikes the ground first, bearing the full brunt of the impact of the step. A cushioning system is needed that will absorb the forces of the heelstrike, while simultaneously assisting the wearer to propel the foot forward through the rest of the step.

SUMMARY OF THE INVENTION

Described herein is a shoe having a sole for cushioning a heelstrike. The sole includes a midsole, an optional outsole, and a resilient cushioning device. The resilient cushioning device is disposed within the midsole in a heel region of the sole. The resilient cushioning device includes a bottom component, a top component, and a corrugated sidewall sealingly attached to the top and bottom components. The resilient cushioning device contains a fluid, such as a gas either at atmospheric pressure or pressurized.

In a second embodiment, the resilient cushioning device includes at least two compartments. A first compartment is disposed along a periphery of the resilient cushioning device. A second compartment is disposed generally in a middle portion of the resilient cushioning device and is fluidly connected to the first compartment. The resilient cushioning device is positioned in the sole such that the second chamber is disposed beneath a wearer's calcaneus bone.

BRIEF DESCRIPTION OF THE DRAWINGS/FIGURES

Features, aspects and advantages of the present invention will become better understood with reference to the following description, appended claims, and accompanying drawings wherein:

DETAILED DESCRIPTION OF THE INVENTION

Specific embodiments of the present invention are now described with reference to the figures, where like reference numbers indicate identical or functionally similar elements.

Figure 1:
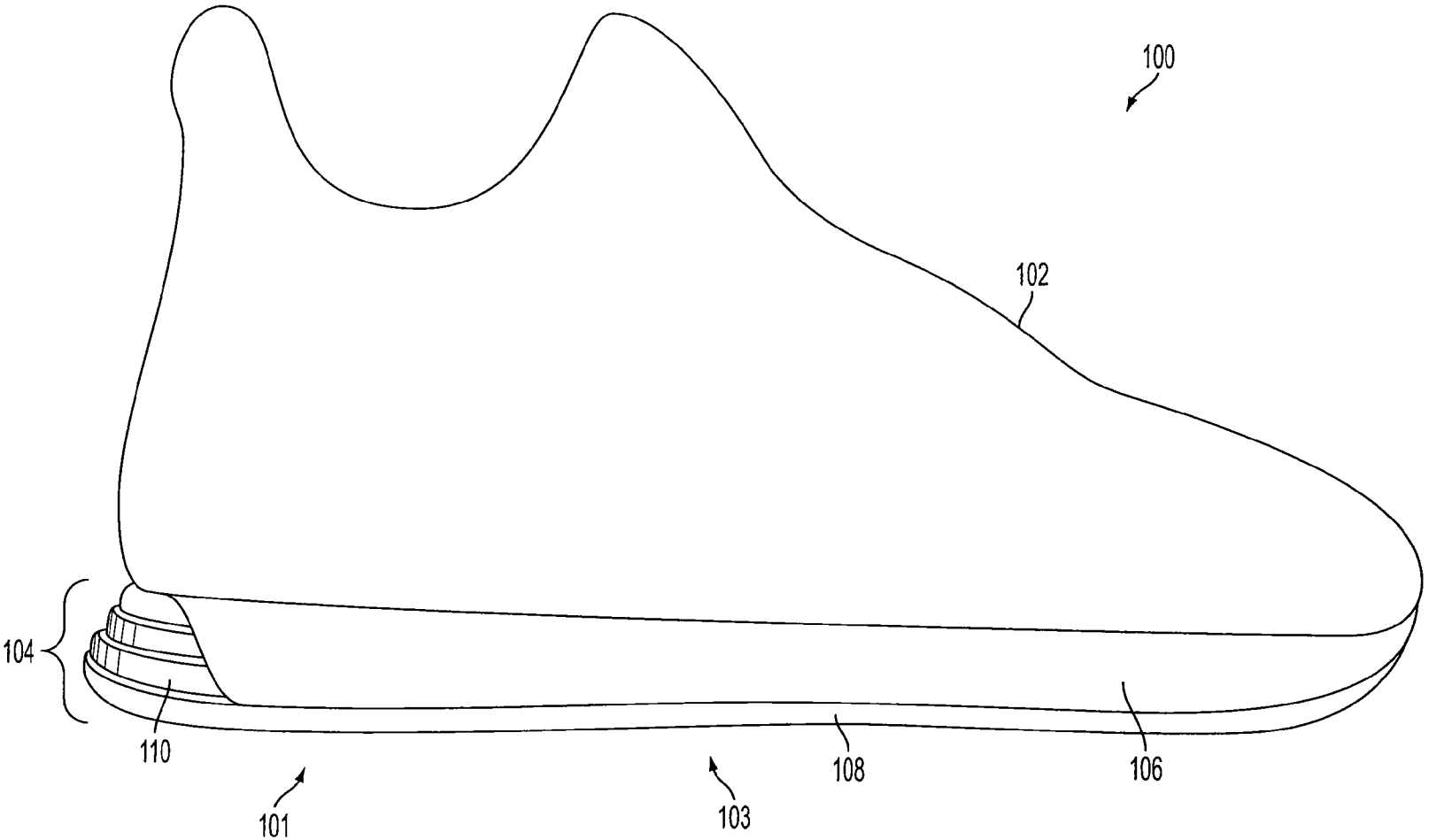
FIG. 1 shows a side view of a shoe having a cushioning sole according to one embodiment of the present invention.
Figure 1A:
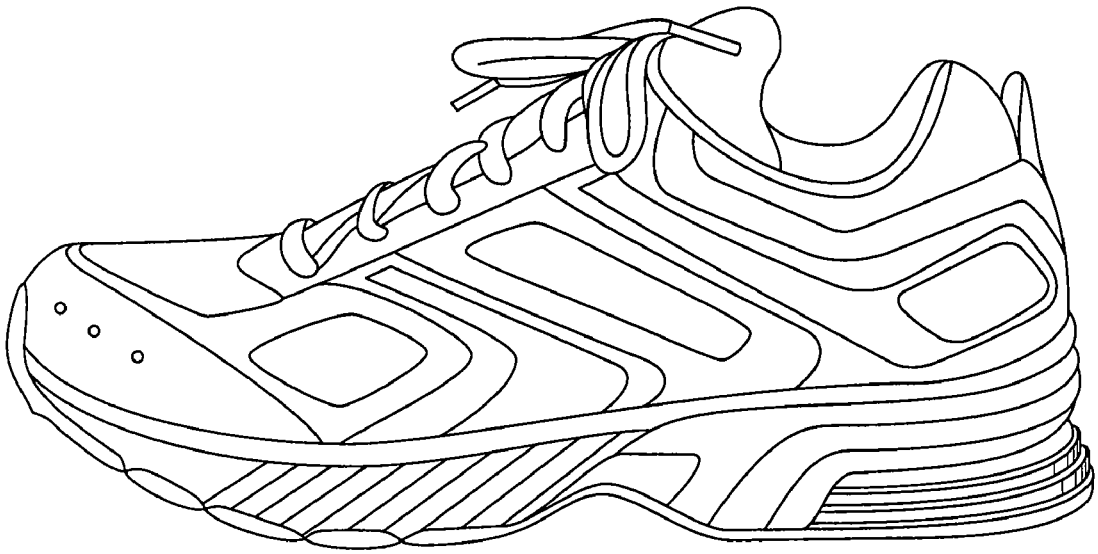
FIG. 1A is a side view photograph of a second embodiment of a shoe having a cushioning sole according to the present invention.
Figure 1B:
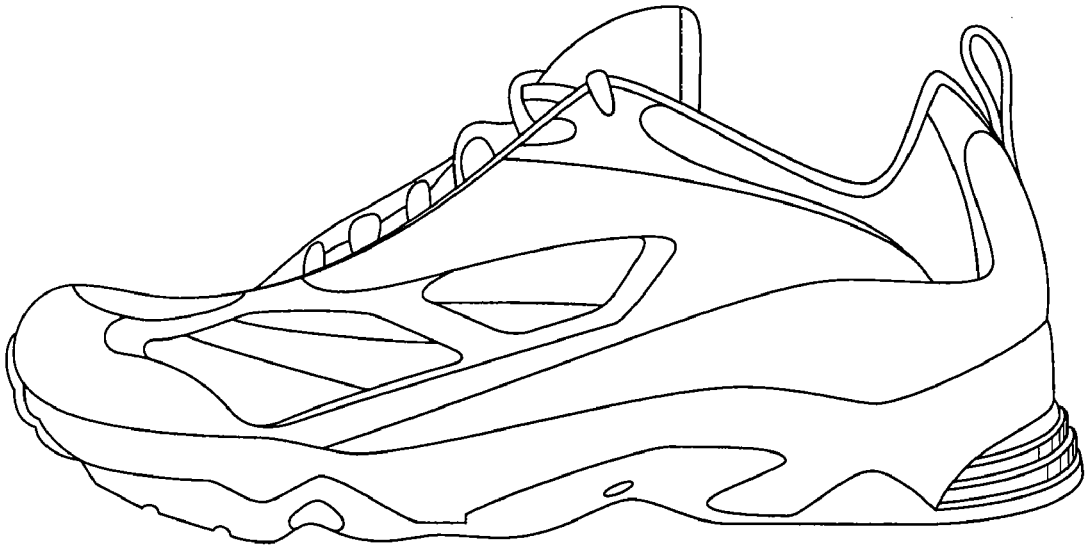
FIG. 1B is a side view photograph of a third embodiment of a shoe having a cushioning sole according to the present invention.
Figure 1C:
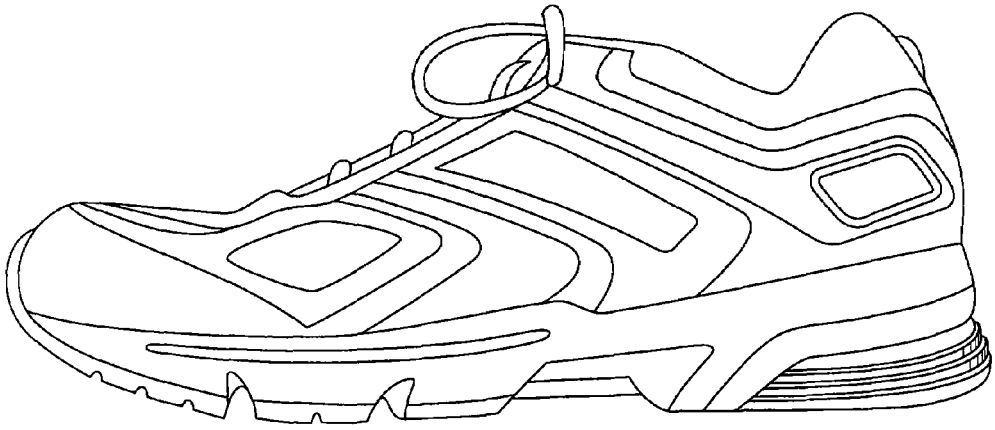
FIG. 1C is a side view photograph of a fourth embodiment of a shoe having a cushioning sole according to the present invention.
Figure 1D:
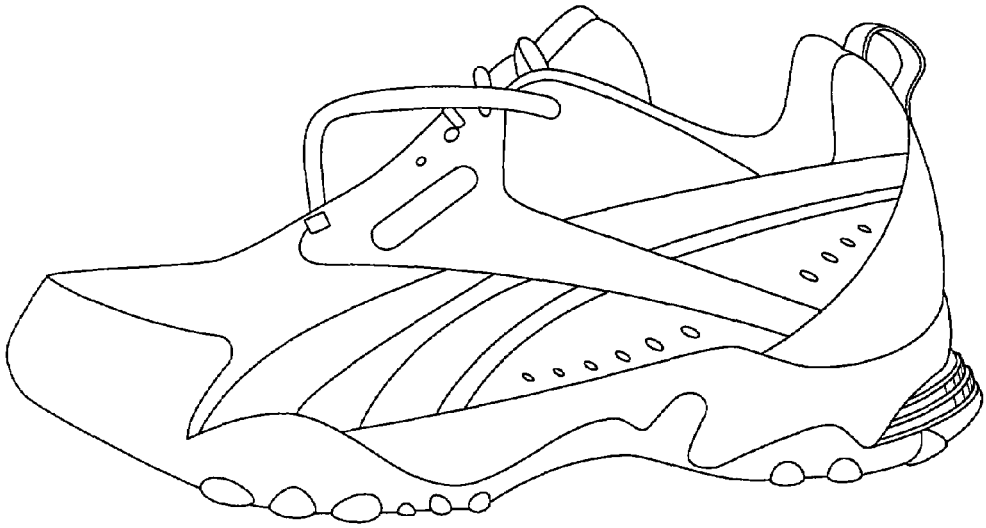
FIG. 1D is a side view photograph of a fifth embodiment of a shoe having a cushioning sole according to the present invention.
Figure 1E:
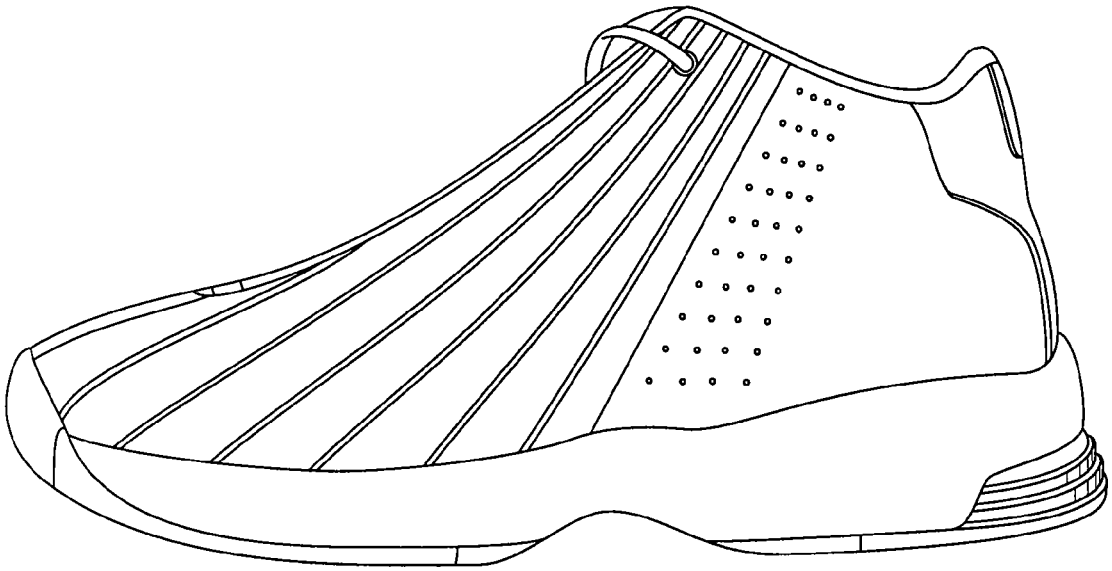
FIG. 1E is a side view photograph of a sixth embodiment of a shoe having a cushioning sole according to the present invention.

Referring now to FIG. 1, a shoe 100 is shown having an upper 102 and a sole 104. Shoe 100 may be any type of shoe known in the art, such as an athletic shoe, a dress shoe, or a sandal. Upper 102 may be made of any material appropriate for use as the upper of a shoe, such as leather, cloth, vinyl, or plastic. Alternative embodiments of shoe 100 are shown in FIGS. 1A-1E, for the purposes of example.

Sole 104 includes a midsole 106, a resilient cushioning device 110, and an optional outsole 108. Sole 104 may be constructed using any method known in the art, such as by cementing the various components thereof together.

Midsole 106 is similar to other midsoles known in the art, where the function thereof is to cushion the foot during the step. As such, the characteristics of midsole 106 will vary according to the intended use of shoe 100. For example, midsole 106 will be relatively thick and resilient in an athletic shoe, while midsole 106 will be relatively thin in a dress shoe. Midsole 106 may be made from any material known in the art that is appropriate for a midsole, such as EVA, either injection or compression molded, rubber, or thermoplastic urethane (TPU). For the purposes of example only, in one embodiment shoe 100 is an athletic shoe. Midsole 106 in this embodiment is made from compression molded EVA, having a durometer measurement between 49 and 67° on an Asker C scale. The thickness of midsole 106 ranges between 9 mm and 24 mm, with the thin portion in the forefoot and the thicker portion in the rearfoot. These dimensions are for one embodiment only; other designs of shoe 100 will involve different dimensions depending on the material of midsole 106 and the amount of desired cushioning.

Shoe 100 also includes optional outsole 108. Outsole 108 is similar to other outsoles known in the art, where outsole 108 is a ground-engaging interface providing traction for the step. Outsole 108 is made from any material known in the art that is appropriate for use as an outsole, typically a wear-resistant resilient material such as rubber.

Resilient cushioning device 110 is disposed in a heel region 101 of sole 104. Resilient cushioning device 110 flexes and deforms to absorb the impact of a heelstrike, then releases the energy stored therein to help push the heel forward. Resilient cushioning device 110 is a hollow enclosed container, or bladder, made of a fluid-tight material such as TPU, although other similarly resilient materials are also appropriate. In one embodiment, resilient cushioning device 110 is disposed in heel region 101 such that a portion of resilient cushioning device 110 is exposed, i.e., resilient cushioning device 110 is visible to a person looking at heel region 101 of shoe 100. For example, resilient cushioning device 110 may be positioned such that resilient cushioning device 110 forms a back wall of heel region 101 and extends forward towards an arch region 103 of shoe 100. Resilient cushioning device 110 is so positioned such that resilient cushioning device 110 is most likely to strike the ground first, i.e., so that the resilient cushioning device 110 is positioned in the most likely heelstrike region of shoe 100.

Figure 2:
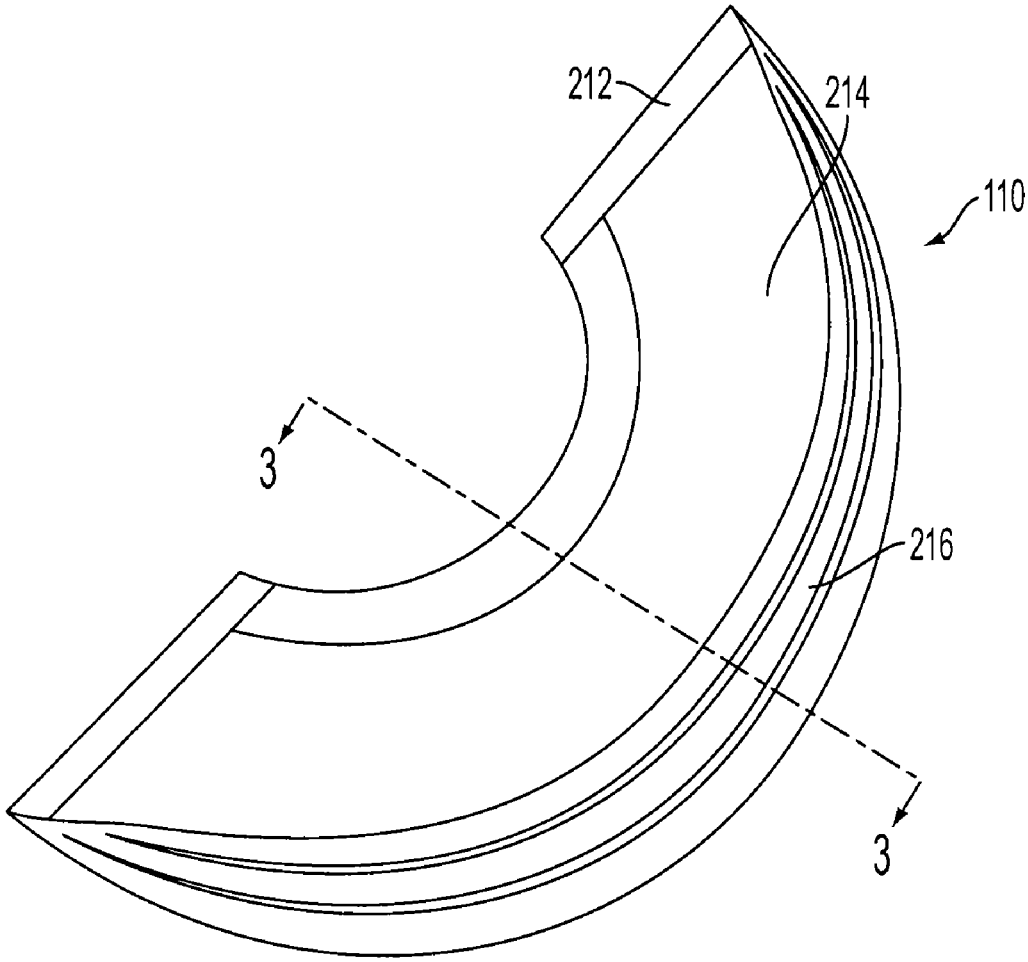
FIG. 2 shows a top view of a cushioning resilient cushioning device removed from the sole of FIG. 1.
Figure 2A:
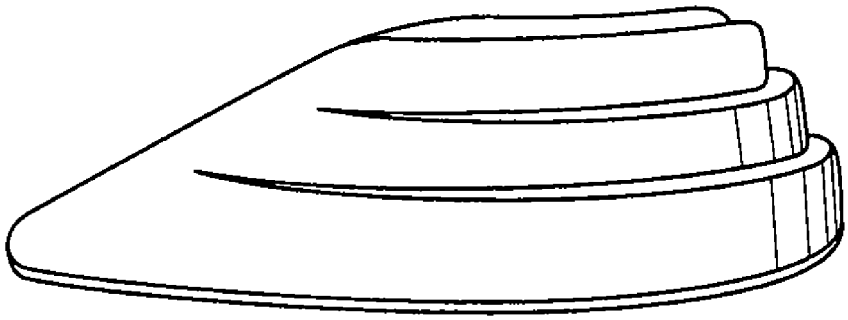
FIG. 2A is a side view photograph of the cushioning resilient cushioning device illustrated in FIG. 2.
Figure 2B:
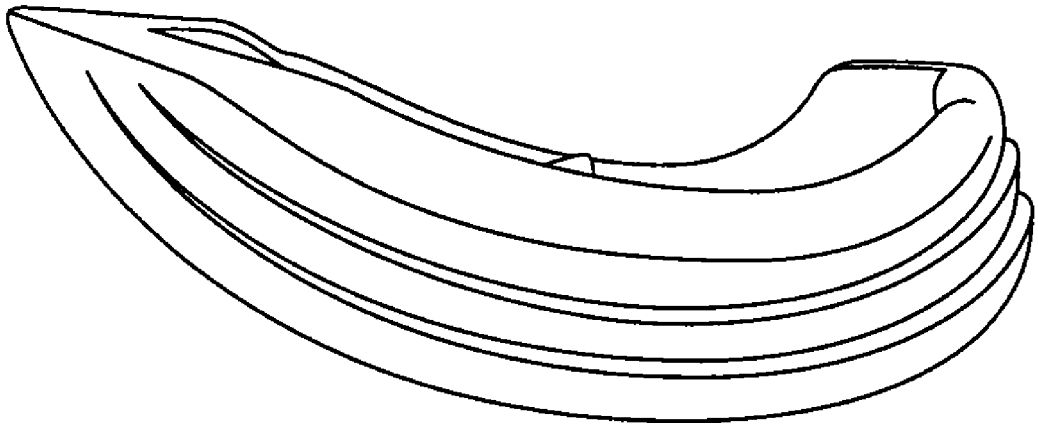
FIG. 2B is a perspective view photograph of the cushioning resilient cushioning device illustrated in FIG. 2.
Figure 2C:
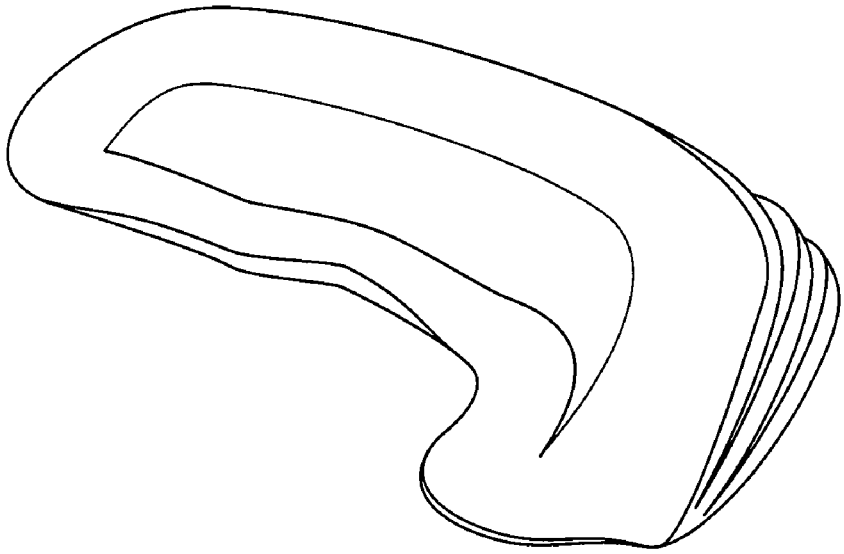
FIG. 2C is a perspective view photograph of a second embodiment of a cushioning resilient cushioning device according to the present invention, as removed from the sole shown in FIG. 1C.
Figure 2D:
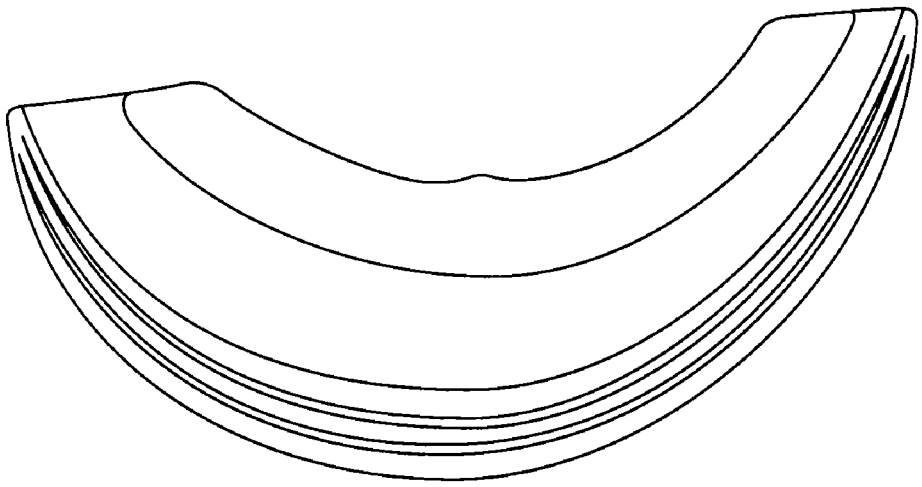
FIG. 2D is a perspective view photograph of a third embodiment of a cushioning resilient cushioning device according to the present invention, as removed from the sole shown in FIG. 1D.
Figure 2E:
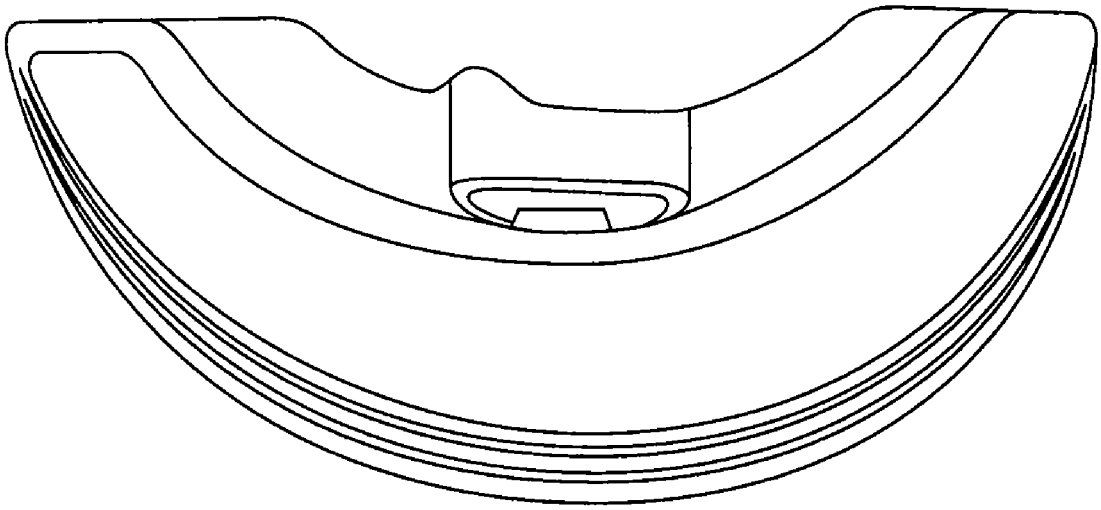
FIG. 2E is a perspective view photograph of the first embodiment of the cushioning resilient cushioning device according to the present invention, as removed from the sole shown in FIG. 1E.

Referring now to FIG. 2, a top view of one embodiment of resilient cushioning device 110 (not in situ) is shown. Resilient cushioning device 110 is placed along the periphery of heel region 101. Resilient cushioning device 110 includes a bottom component 318 (shown in FIG. 3) and a top component 214 having a sidewall 216 having an upper edge 305 and a bottom edge 307. In this embodiment, resilient cushioning device 110 is generally crescent-shaped and wedge-shaped, with top component 214 and sidewall 216 connected at upper edge 305 and sidewall 216 connected to bottom component 318 at bottom edge 307. Top component 214 is welded to bottom component along a weld line 212. In another embodiment, bottom component 318 includes sidewall 216 and top component 214 is welded thereto. In yet another embodiment, resilient cushioning device 110 may be molded in its entirety, such that top component 214 and/or sidewall 216 need not be separately affixed to bottom component 318, or may be three separate pieces such that top component 214 must be sealingly attached to bottom component 318 and both components 214, 318 sealingly attached to sidewall 216. Alternative embodiments of resilient cushioning device 110 are shown in FIGS. 2C-2E, for the purposes of example.

Figure 3:
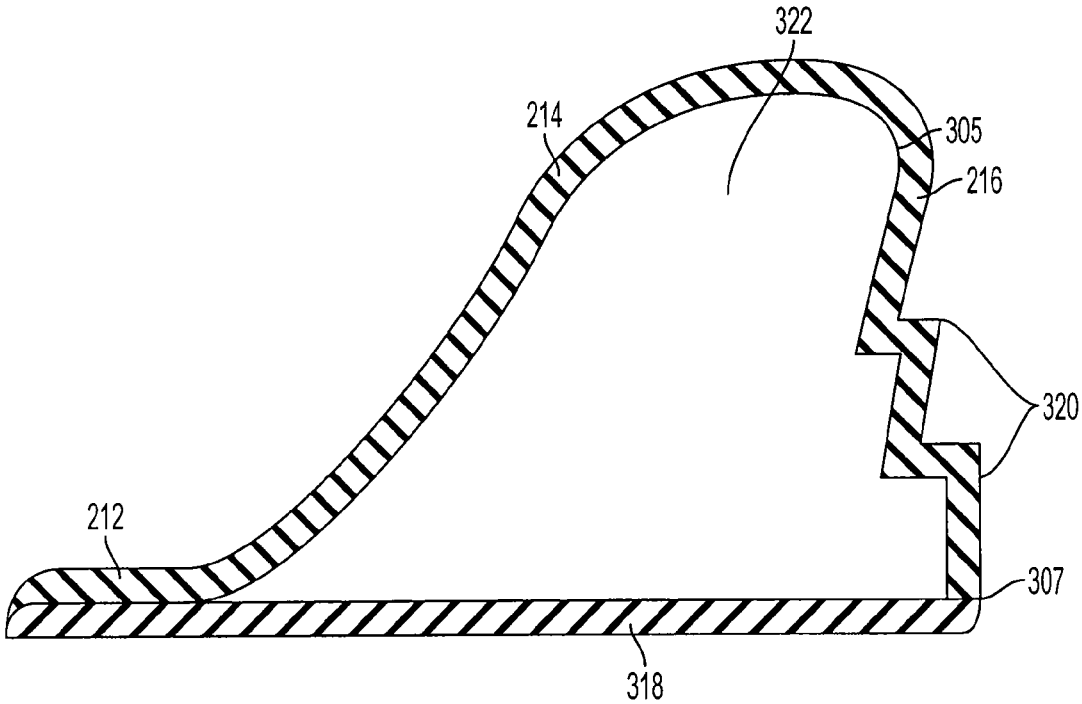
FIG. 3 shows a cross-sectional view of the resilient cushioning device of FIG. 2, taken along line A-A.

Referring now to FIG. 3, a cross-sectional view of resilient cushioning device 110 taken along line A-A of FIG. 2 is shown. As can be seen more clearly in FIG. 3, sidewall 216 has a corrugated shape, formed by ridges or corrugations 320. For example, as shown in FIG. 3, ridges 320 can be stepped and increasingly protruding from top component 214 to bottom component 318 and have at least one wall substantially perpendicular to said bottom component. These corrugations 320 assist in the flexing of resilient cushioning device 110 when pressure is applied to resilient cushioning device 110 during a heelstrike. Further, corrugations 320 also assist in returning resilient cushioning device 110 to its original shape when the pressure from the step is released from the heel portion of shoe 100 as the foot rolls forward through the step, as corrugations 320 behave like a spring. The behavior of sidewall 216 is discussed further infra.

The thickness of bottom component 318, top component 214, and sidewall 216 will vary according to the amount of flex desired from resilient cushioning device 110. If the walls of resilient cushioning device 110 are too thin, resilient cushioning device 110 may fail under the repeated pressure of heelstrikes. Further, the thickness of the walls may vary in the same resilient cushioning device 110, so that resilient cushioning device 110 may flex more in one area, but have additional structural integrity in other areas. For the purposes of example only, in one embodiment, the thickness of resilient cushioning device 110 in the vicinity of weld line 212 is approximately 2.0 mm, the thickness of top component 214 is 1.0 mm, the thickness of a top corrugation of sidewall 216 is 1.0 mm, and the thickness of a bottom corrugation of sidewall 216 is approximately 2.0 mm.

Three (3) corrugations 320 are shown in the embodiment of FIG. 3, however, this number may be altered according to the amount of give desired from resilient cushioning device 110. Also, in one embodiment sidewall 216 is exposed, so the number of corrugations may also be chosen to alter the visual aesthetics of sole 104.

The height of corrugations 320 will vary depending upon the desired amount of displacement during the flexing of resilient cushioning device 110. The height of corrugations 320 is therefore dependent upon the number of corrugations 320 included with resilient cushioning device 110. For the purposes of example only, such as in the embodiment shown in FIG. 3 with three corrugations 320, the height of corrugations 320 is approximately 1.0 mm.

As stated above, resilient cushioning device 110 is a hollow container, and an interior volume 322 is enclosed by top component 214 and bottom component 318. Disposed within interior volume 322 is a fluid. The fluid provides resistance to the impact of the heelstrike so that resilient cushioning device 110 provides increased cushioning. Resilient cushioning device 110 is a closed fluid system, so that the fluid contained therein is not readily exchanged with any external fluids. Also, the pressure of the fluid cannot be increased without deforming resilient cushioning device 110.

The fluid may be a liquid or a gel, although these materials can undesirably increase the weight of shoe 100. Alternatively, the fluid may be a gas, such as air, nitrogen, or another large molecule inert gas. The larger the molecule of the gas, the lower the dispersion rate will be through the walls of resilient cushioning device 110. If a gas is used, the gas may be at atmospheric pressure, which will also decrease the rate of dispersion through the walls of resilient cushioning device 110. Alternatively, the gas may be pressurized, so that the gas is at a pressure higher than the ambient air pressure. The increased pressure of the gas increases the overall cushioning provided by resilient cushioning device 110. However, if the gas is pressurized too much, resilient cushioning device 110 will be prone to failure such as by explosion upon the impact of the heelstrike. For the purposes of example only, in one embodiment, the fluid is nitrogen pressurized to 6 psi.

In another embodiment, the fluid is air at ambient air pressure. If air at ambient pressure is used, the thickness of the walls of resilient cushioning device 110 may need to be increased to increase the resistance to the pressure of the heelstrike.

The cushioning provided by sole 104 during a normal step is now described. Initially, resilient cushioning device 110 of sole 104 is in a first undeformed shape. When the heelstrike occurs, resilient cushioning device 110 resists the impact through the motion of the fluid within resilient cushioning device 110 as well as the natural resistance of the walls of resilient cushioning device 110 to deformation. The fluid within resilient cushioning device 110 moves away from the region of impact as resilient cushioning device 110 deforms, thereby increasing the pressure of the fluid within the reduced available volume within resilient cushioning device 110. This increased pressure helps to cushion the foot during the heelstrike. Further, if sidewall 216 includes corrugations 320, then resilient cushioning device 320 will tend to deform corrugations 320 in an accordion-like fashion. The deformation of resilient cushioning device 320 stores energy within resilient cushioning device 110.

As the wearer's foot rolls forward through the step, the external pressure placed upon resilient cushioning device 110 is released. As this pressure is removed, the energy stored within deformed resilient cushioning device 110 is also released, thereby providing an extra spring to the step and assisting with the toe-off. Resilient cushioning device 110 resumes its initial shape and internal pressure in preparation for the next step.

Figure 4:
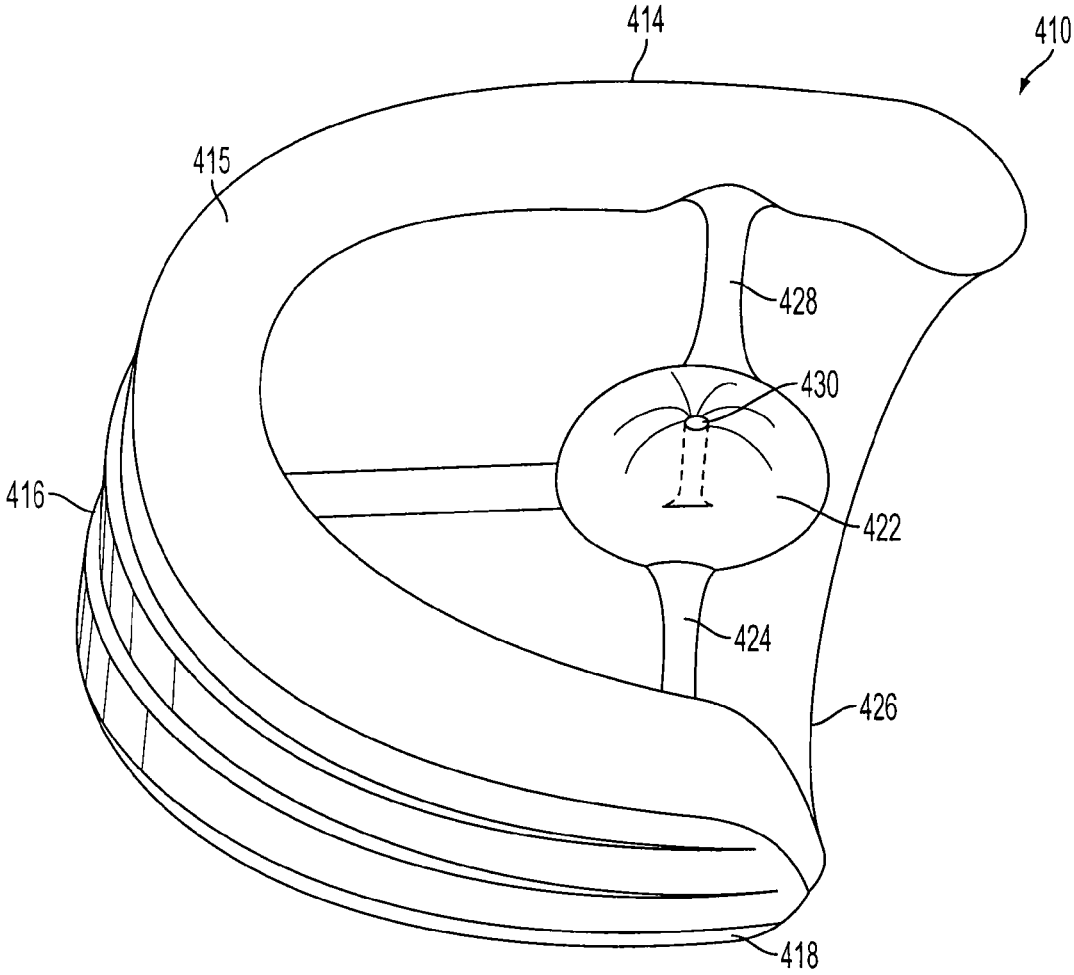
FIG. 4 shows a perspective view of an alternate embodiment of the resilient cushioning device of the present invention.
Figure 4A:
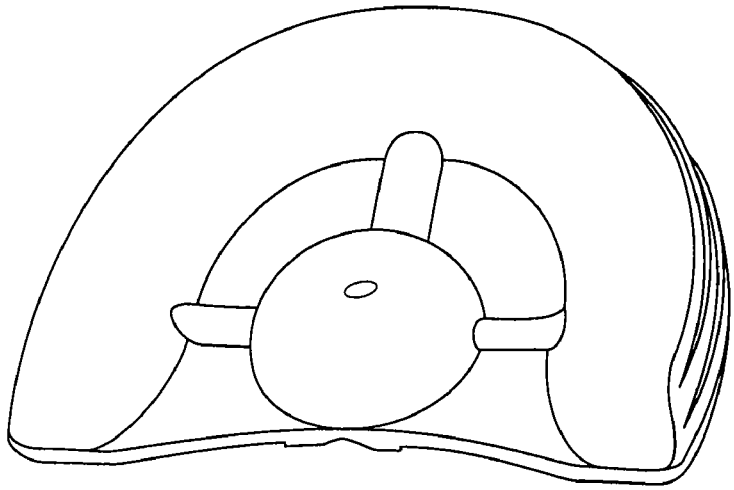
FIG. 4A is a perspective view photograph of the cushioning resilient cushioning device illustrated in FIG. 4.
Figure 4B:
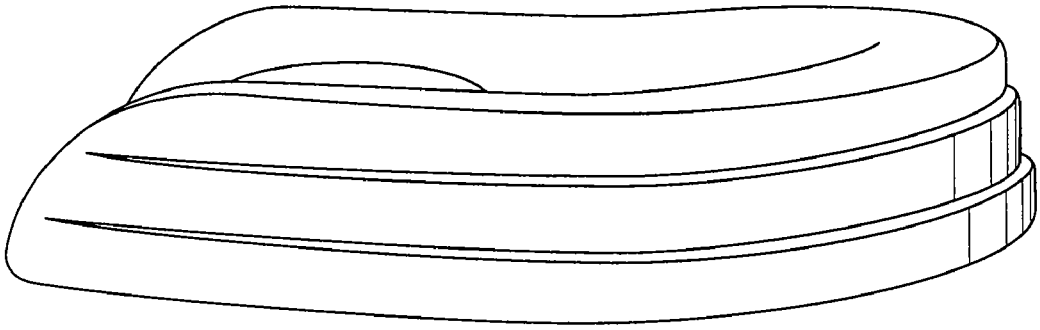
FIG. 4B is a side view photograph of the cushioning resilient cushioning device illustrated in FIG. 4.

Referring now to FIG. 4, a resilient cushioning device 410 is shown. Resilient cushioning device 410 is an alternate embodiment of resilient cushioning device 110. Resilient cushioning device 410 may be disposed within shoe 100 in a similar fashion to resilient cushioning device 110, i.e., with a portion of resilient cushioning device 410 exposed along the rear end of shoe 100 and the rest of resilient cushioning device 410 embedded within midsole 106.

Similar to resilient cushioning device 110, described above, resilient cushioning device 410 is made of a resilient fluid-tight material, such as TPU. Also similar to resilient cushioning device 110, resilient cushioning device 410 includes a top component 414, a bottom component 418, and a corrugated sidewall 416. Also, a fluid similar in all respects to the fluid contained within resilient cushioning device 110 is also contained within resilient cushioning device 414, such as air at atmospheric pressure or pressurized nitrogen.

However, while resilient cushioning device 110 is a generally wedge-shaped, single compartment device, resilient cushioning device 410 is a relatively larger component that includes several internal compartments or chambers defined by the topography of top component 414. A first chamber 415 is a large, tube-like chamber disposed along a periphery of resilient cushioning device 410. First chamber 415 is shaped somewhat like a half-donut, although the donut tapers on a leading edge 426 of resilient cushioning device 410 so that top component 414 may be sealingly attached to bottom component 418.

A second chamber 422 is disposed towards the center of resilient cushioning device 410. Second chamber 422 is relatively small compared to first chamber 415. Second chamber 422 is a hollow dome-like structure, where a center 430 of second chamber is dimpled and sealed to bottom component 418.

The placement of second chamber 422 in the center portion of resilient cushioning device 410 is to provide additional cushioning in the region of the calcaneus bone. As such, resilient cushioning device 410 is positioned within midsole 106 in one embodiment such that corrugated sidewall 416 is exposed and forms the outer periphery of heel region 101 of shoe 100 and second chamber 422 is positioned more centrally so as to cushion the calcaneus bone at the point of lowest extension.

Second chamber 422 is fluidly connected to first chamber 415 through a series of conduits 428. Although three (3) such conduits 428 are shown in FIG. 4, this number can vary depending upon the desired movement of fluid within and between first chamber 415 and second chamber 422. Together, first chamber 415, second chamber 422, and conduits 428 constitute a fluid system so that the fluid contained within resilient cushioning device 410 may dynamically flow within resilient cushioning device 410 when external pressure is imposed upon resilient cushioning device 410.

Figure 5:
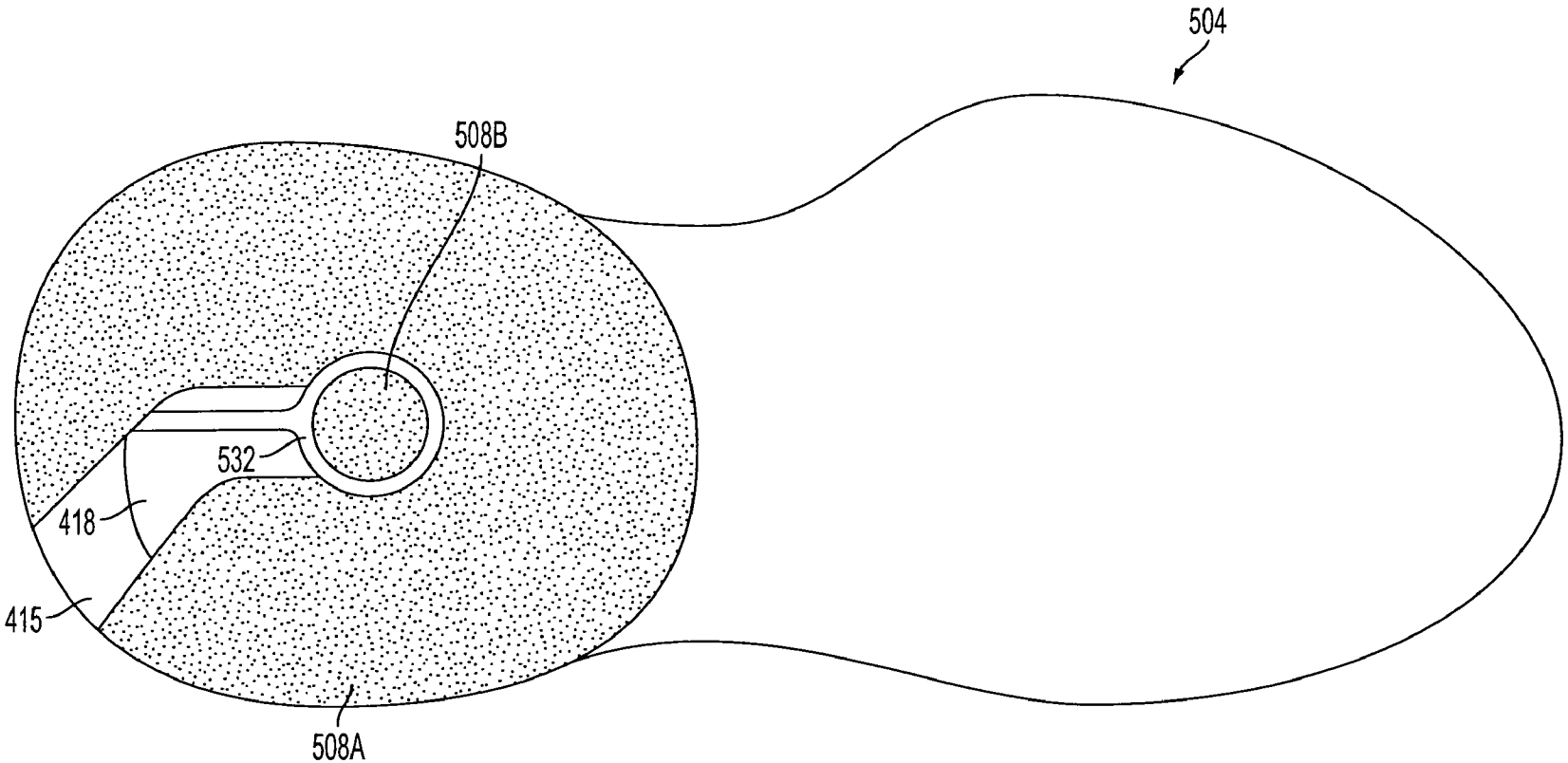
FIG. 5 shows a bottom view of a sole of a shoe incorporating the resilient cushioning device of FIG. 4 with an outsole thereof partially cut away.

As seen more clearly in FIG. 5, a bottom plan view of a sole 504 incorporating resilient cushioning device 410, a ring 532 on bottom component 418 can be seen. In this embodiment, the outsole includes two portions, an outer outsole 508A and an inner plug 508B. Ring 532 corresponds in location to second chamber 422 (shown only in FIG. 4). Ring 532 protrudes downward from bottom component 418 to help increase the pressure applied to second chamber 422 (shown only in FIG. 4) and thereby increase the circulation of air therewithin, described in greater detail infra.

Figure 5A:
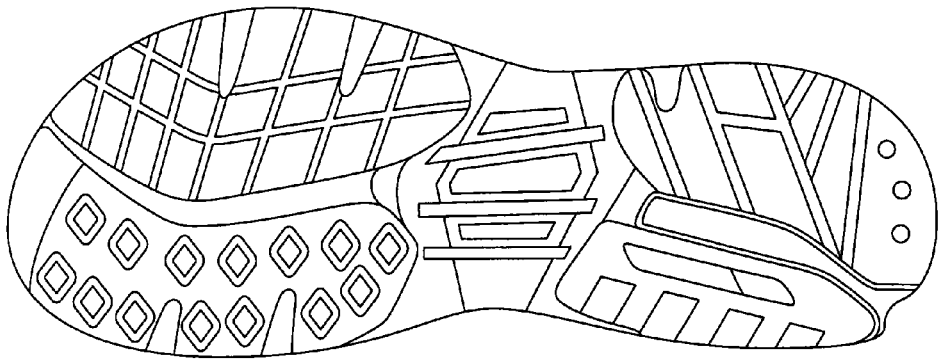
FIG. 5A is a photograph of a bottom view of the sole shown in FIG. 1C.
Figure 5B:
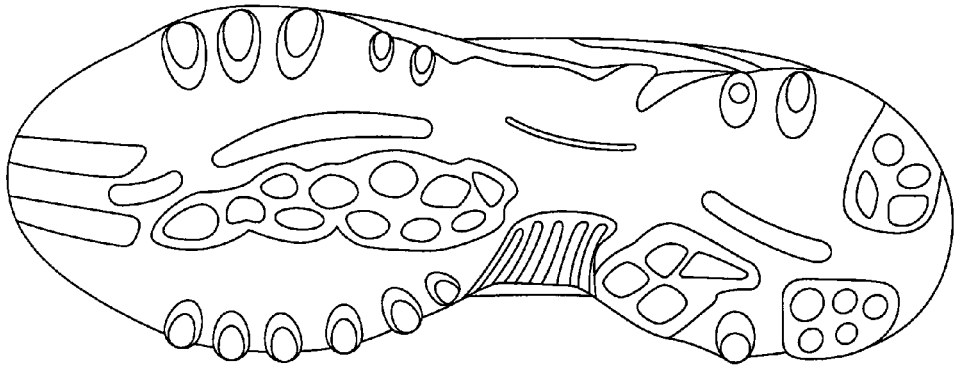
FIG. 5B is a photograph of a bottom view of the sole shown in FIG. 1D.
Figure 5C:
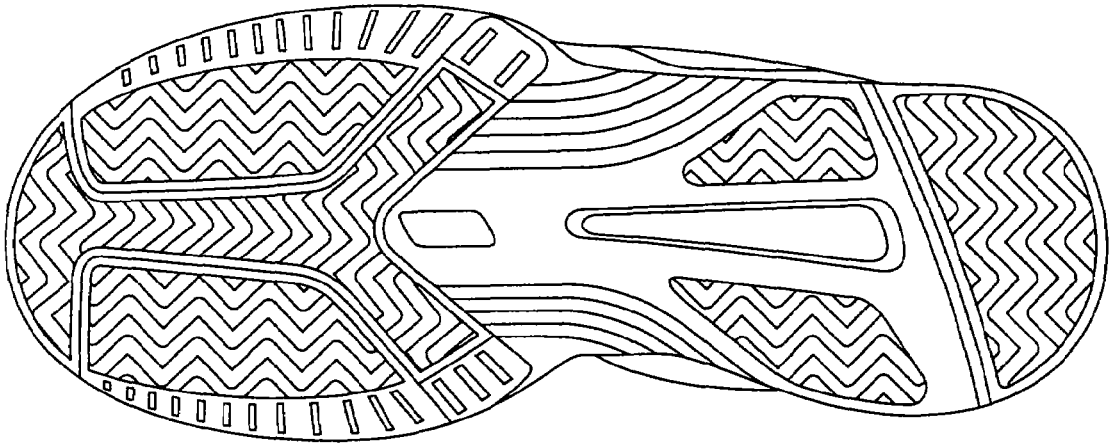
FIG. 5C is a photograph of a bottom view of the sole shown in FIG. 1E.

A portion of an outsole 508A is shown cut away in FIG. 5, although outsole 508A may also cover the entirety of bottom component 418 except for ring 532, or outsole 508A and plug 508B may merge to completely cover bottom component 418. If bottom component 418 is exposed to the ground, the deflection of resilient cushioning device 410 may be increased as outsole 508A would not absorb any of the impact of the heelstrike. Other configurations of a cut-away of outsole 508A may be chosen for specific increase in deflection in one portion of resilient cushioning device 410 or for aesthetic purposes. However, completely covering bottom component 418 with outsole 508A may increase traction, reduce the vulnerability of resilient cushioning device 410 to failure through increased wear or exposure to puncture hazards, or inhibit the generation of an undesirable clicking noise. Alternative embodiments of sole 504 are shown in FIGS. 5A-5C for the purposes of example.

Resilient cushioning device 410 functions similarly to resilient cushioning device 110, described above. When a heelstrike occurs, a portion of first chamber 415 is compressed. This compression reduces the available internal volume of chamber 415, and the fluid contained therein begins to flow. The fluid flow to other portions of chamber 415, as well as through conduits 428 and into second chamber 422. The pressure of the fluid in the system is also increased, due to the lowered available volume within resilient cushioning device 410, thereby cushioning the foot.

Additionally, the walls of resilient cushioning device 410 deform and absorb a portion of the energy from the heelstrike. In particular, corrugated sidewall 416 compresses in an accordion-like fashion.

As the foot rolls forward through the step, the external pressure from the force of the step on first chamber 415 is relieved. Consequently, the fluid will begin to flow back into the previously compressed region of first chamber 415. As the foot rolls forward, increased external pressure is placed on other portions of resilient cushioning device 410, such as second chamber 422 so that the calcaneus may be cushioned throughout the entire step. This rolling external pressure influences the flow of the fluid through the fluid system within, thereby dynamically cushioning the heel throughout the step, particularly when second chamber 422 is compressed and forces the fluid back through the fluid system.

As the foot continues to roll towards the toe region for toe-off, resilient cushioning device 410 resumes its initial shape and pressurization. This release of energy as resilient cushioning device 410 springs back into shape assists the rolling of the foot towards the toe region. As such, resilient cushioning device 410 both cushions and energizes the step.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents. All patents and publications discussed herein are incorporated in their entirety by reference thereto.

What is claimed is:

1. An article of footwear, comprising;

an upper;

a sole attached to said upper, said sole having a heel portion and a forefoot portion, a resilient cushioning device disposed within said heel portion of said sole, said resilient cushioning device comprising a generally flat bottom component and a top component having at least one contoured portion sealed along a perimeter thereof, wherein said top component and said bottom component define an interior volume and wherein said top component includes a sidewall having a plurality of stepped ridges increasingly protruding from said top component to said bottom component and wherein each stepped ridge comprises at least one wall substantially perpendicular to said bottom component.

2. The article of footwear of claim 1, wherein said top component of said resilient cushioning device includes a sloped region opposite said sidewall, such that said cushioning device is generally wedge shaped.

3. The article of footwear of claim 1, wherein said resilient cushioning device is generally curved and conforms with a perimeter of said heel portion of said sole.

4. The article of footwear of claim 3, wherein at least a portion of said sidewall of said resilient cushioning device is visible from an exterior of said sole.

5. The article of footwear of claim 1, wherein said sole further includes a midsole component having an at least one recess therein, said at least one recess being capable of receiving at least a portion of said resilient cushioning device.

6. The article of footwear of claim 1, wherein said sole further includes an outsole covering at least a portion of said sole wherein said resilient cushioning device is positioned within said sole.

7. The article of footwear of claim 1, wherein said resilient cushioning device includes a horseshoe-shaped chamber that corresponds to at least a portion of a perimeter of said heel portion of said sole.

8. The article of footwear of claim 7, wherein said resilient cushioning device also included an annular chamber fluidly connected with said horseshoe-shaped chamber, wherein said annular chamber is disposed within the same plane as horseshoe-shaped chamber and positioned within an area surrounded by horseshoe-shaped chamber on at least three sides.

9. The article of footwear of claim 8, wherein at least a portion of said annular chamber is defined by said contoured portion of said top component and a corresponding contoured portion of said bottom component.

10. The article of footwear of claim 8, wherein said annular chamber is fluidly connected with said horseshoe-shaped chamber via at least one conduit.

11. The article of footwear of claim 10, wherein said at least one conduit is defined by one of said at least one contoured portion of said top component.

12. The article of footwear of claim 10, wherein at least three conduits fluidly connect said horseshoe-shaped chamber and said annular chamber.

13. The article of footwear of claim 12, wherein a first conduit is connected from a first location on said annular chamber to generally a first end of said horseshoe-shaped chamber, a second conduit is connected from a second location on said annular chamber, which is about 90 degrees from said first location on said annular chamber, to generally a central portion of said horseshoe-shaped chamber, and a third conduit is connected from a third location on said annular chamber, which is about 180 degrees from said first location on said annular chamber, to generally a second end of said horseshoe chamber, which is opposite said horseshoe-shaped chamber from said first end.

14. The article of footwear of claim 1, wherein said interior volume is filled with a fluid.

15. The article of footwear of claim 14, wherein said interior volume includes air at ambient pressure.

16. The article of footwear of claim 14, wherein said interior volume includes a pressurized gas.

17. The article of footwear of claim 8, wherein said annular chamber is positioned with said shoe sole generally beneath a calcaneus bone of an intended wearer's foot.

18. A shoe sole, comprising:

a midsole having an upper surface and a lower surface, said lower surface being closer than said upper surface to a ground-contacting portion of said shoe sole, a resilient cushioning device disposed within said midsole along a periphery of a shoe sole, wherein said resilient cushioning device is a fluid-tight container that includes a sidewall having a plurality of stepped ridges increasingly protruding from said upper surface to said lower surface of said midsole and wherein each stepped ridge comprises at least one wall substantially perpendicular to said lower surface;

wherein at least a portion of said sidewall is visible from an exterior of said shoe sole.

19. The shoe sole of claim 18, wherein said resilient cushioning device is disposed within a heel region of said shoe sole.

20. The shoe sole of claim 18, wherein said resilient cushioning device is filled with air at ambient pressure.

* * * * *